US006743489B2

(12) United States Patent
Compton et al.

(10) Patent No.: US 6,743,489 B2
(45) Date of Patent: Jun. 1, 2004

(54) INSULATED GLASS AND METHOD OF MAKING SAME

(75) Inventors: Cheryl Crozier Compton, Grand Haven, MI (US); Ricky Dale Roels, Holland, MI (US)

(73) Assignee: ODL, Incorporated, Zeeland, MI (US)

( * ) Notice: Subject to any disclaimer, the term of this patent is extended or adjusted under 35 U.S.C. 154(b) by 26 days.

(21) Appl. No.: 09/975,291

(22) Filed: Oct. 11, 2001

(65) Prior Publication Data

US 2003/0072899 A1 Apr. 17, 2003

(51) Int. Cl.[7] ..... E06B 3/24; E06B 3/964; E04C 2/54

(52) U.S. Cl. ..... 428/34; 52/204.62; 52/786.1

(58) Field of Search ..... 428/14, 34, 192; 52/786, 786.13, 209.62

(56) References Cited

U.S. PATENT DOCUMENTS

| | | | | | |
|---|---|---|---|---|---|
| 2,670,508 | A | * | 3/1954 | Sylvan | 428/34 |
| 3,872,198 | A | * | 3/1975 | Britton | 156/109 |
| 4,048,978 | A | * | 9/1977 | Plumat et al. | 126/200 |
| 4,357,187 | A | * | 11/1982 | Stanley et al. | 156/107 |
| 4,984,403 | A | * | 1/1991 | Zarwell | 52/476 |
| 6,055,783 | A | * | 5/2000 | Guhl et al. | 52/204.62 |

* cited by examiner

*Primary Examiner*—Donald J. Loney
(74) *Attorney, Agent, or Firm*—Warner Norcross & Judd LLP

(57) ABSTRACT

An insulated glass assembly including two glass panels each have a plastic frame molded about its perimeter, with the plastic frames welded or otherwise joined together. The molded plastic frames form an airtight seal with each other and with the glass panels.

10 Claims, 5 Drawing Sheets

INSULATED GLASS AND METHOD OF MAKING SAME

BACKGROUND OF THE INVENTION

The present invention relates to insulated glass assemblies and to methods for making insulated glass assemblies.

Insulated glass (IG) assemblies are well known and include a spacer frame and a pair of glass panels adhered to the opposite sides of the spacer frame forming a hermetically sealed unit. The spacer frame typically is fabricated of a plurality of metal rails interconnected by plastic corner keys. The glass panels are adhered to the spacer frame using any one, or a combination of, suitable well known adhesives.

Existing IG assemblies are undesirably difficult to construct. Forming the frame members, cutting each frame member to length, and assembling the frame out of individual frame members is time consuming. Applying adhesive to both sides of the frame also is time consuming and difficult. If the adhesive is not accurately applied, or if the assembly is subsequently jarred, the IG can lose its seal thereby permitting moisture to enter the closed space and condense on the glass panels. Moisture condensation on the inner surfaces of the glass panels is aesthetically unappealing and impossible to correct without replacement of the window unit. The adhesive is aesthetically unattractive if it is applied to, or moves into, the viewing portion of the assembly.

SUMMARY OF THE INVENTION

The aforementioned problems are overcome in the present invention, wherein an insulated glass window includes two glass panels each encapsulated in a plastic frame, and further wherein the plastic frames are welded together. More particularly, each frame is molded or over-molded onto the perimeter of the respective glass panel forming an airtight seal between the frame and the panel; and the two molded frames are welded or otherwise joined together forming an airtight seal between the frames.

As specifically disclosed, at least one of the frames includes at least one rib that partially or completely melts during welding to improve the bond. As further disclosed, the inner surface of at least one of the frames defines a desiccant channel in which desiccant is placed. This desiccant channel is recessed from the viewing area so that the desiccant is essentially hidden from view.

These and other objects, advantages and features of the invention will be more readily understood and appreciated by reference to the detailed description of the preferred embodiment and the drawings.

DETAILED DESCRIPTION OF THE PREFERRED EMBODIMENT

I. Construction

Figure 1:
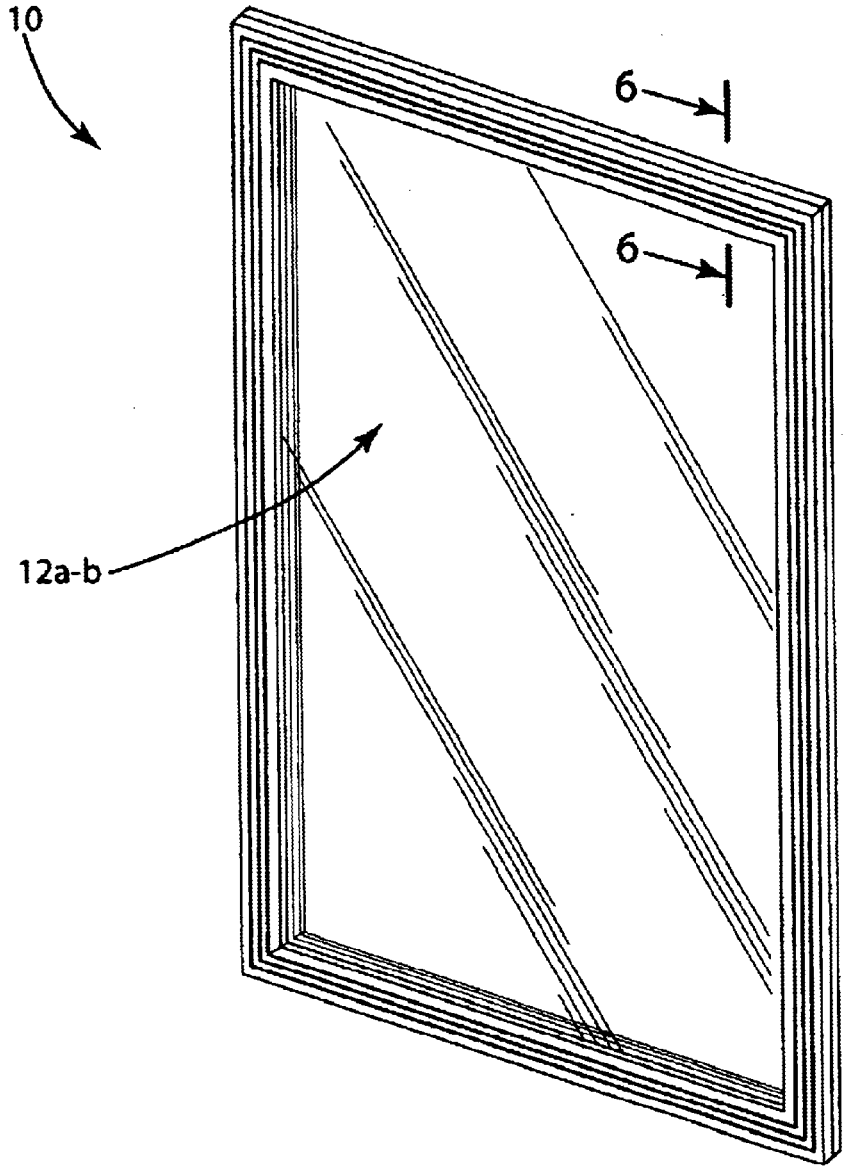
FIG. 1 is a front perspective view of the insulated glass (IG) assembly.
Figure 2:
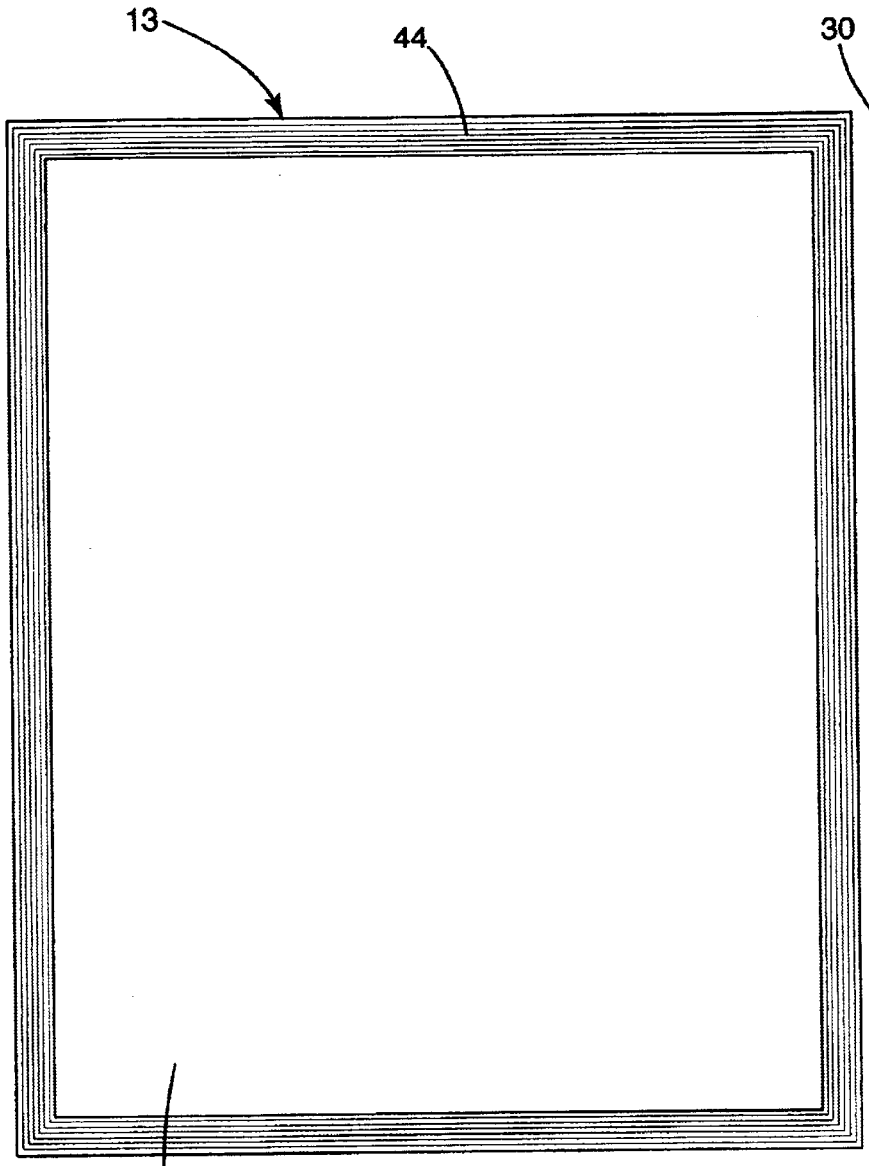
FIG. 2 is a front elevational view of the IG assembly.
Figure 3:
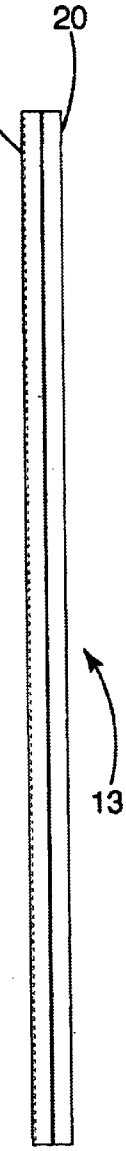
FIG. 3 is a right side view of the IG assembly.

An insulated glass (IG) assembly constructed in accordance with the preferred embodiment of the present invention is illustrated in FIGS. 1–3 and generally designated 10. The IG assembly includes a pair of glass panels 12*a* and *b* and a frame assembly 13. The frame assembly 13 in turn includes frame halves 20 and 30 molded about the glass panels 12*a* and 12*b*, respectively. The frame halves 20 and 30 are welded or otherwise joined together. The IG assembly can be used as a sash in a window, as a fixed panel in a window, or in any environment in which insulated glass is desired.

The panels 12 can be any translucent or transparent material known to those skilled in the art. In the disclosed embodiment, each panel 12 is made of glass approximately an eighth (⅛) of an inch thick, although any thickness may be used. Alternatives are, and will become, known and include safety glass, plastic, such as polycarbonate, or any other transparent or translucent material.

Figure 4:
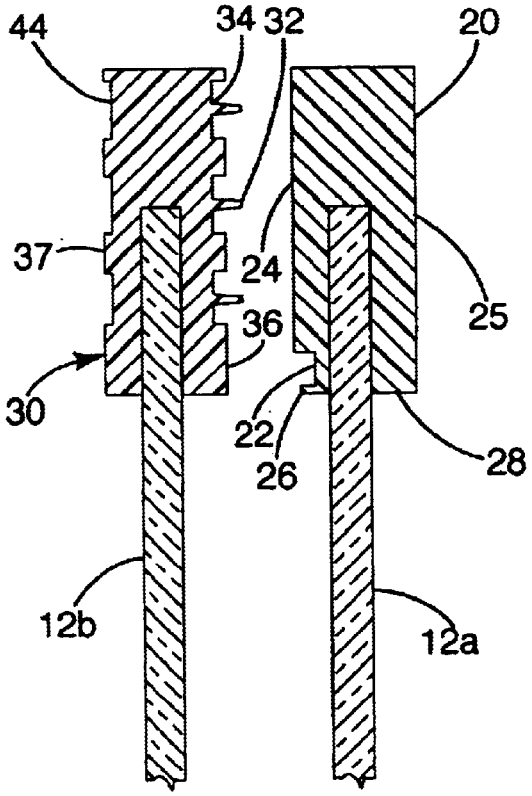
FIG. 4 is a sectional view of the two frame halves before vibration welding.
Figure 8:
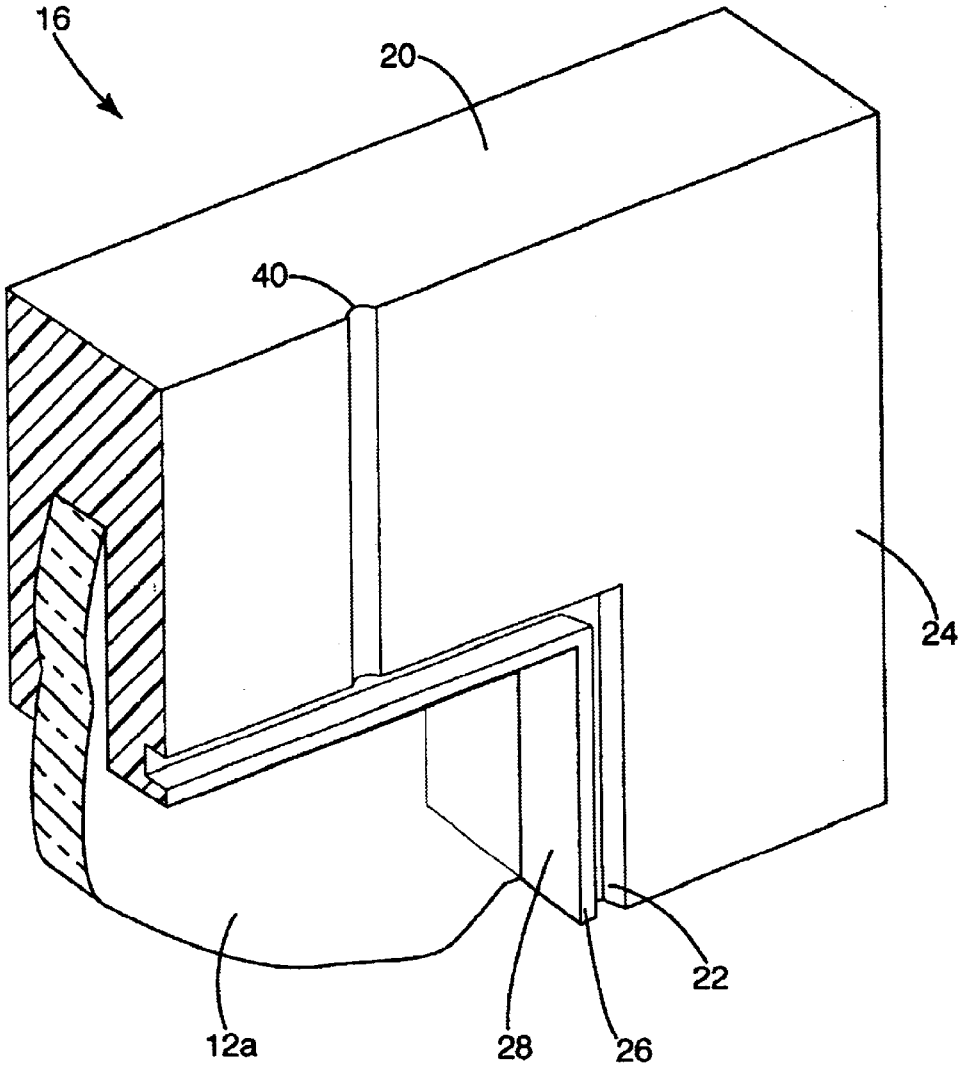
FIG. 8 is a perspective view of a frame half showing the vent channel.

The smooth frame half 20 (FIGS. 4 and 8) is molded about the perimeter of the panel 12*a*. The technology for doing so is well known and is used, perhaps most widely, in fabricating glass refrigerator shelves. The smooth frame half 20 is uniform in cross section and includes an inner surface 24, outer surface 25, a glass-facing surface 28, and a flange 26. The inner surface 24 and the flange 26 together define a desiccant channel 22, and the inner surface 24 may define an optional vent channel 40 oriented generally perpendicularly to the glass-facing surface 28 (see FIG. 8). The desiccant channel 22 extends around the entire inner surface 24 located slightly back from the plane of the glass facing surface 28. The flange 26 extends partially along the planes formed by the glass facing surface 28 around the entire length of the inner perimeter of the smooth frame half 30. The vent channel 40 (FIG. 8) is a groove across the inner surface 24, somewhat perpendicular to the glass facing surface 28. The vent channel 40 may instead be located on the rib frame half 30 or both the rib frame half 30 and the smooth frame half 20.

Figure 7:
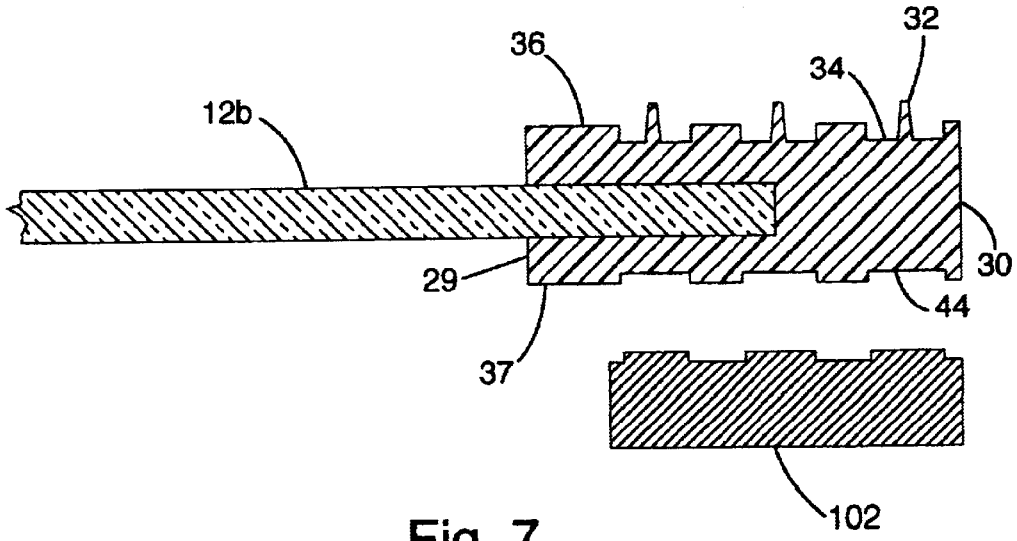
FIG. 7 is a sectional view of a frame half with ribs taken along 8—8 in FIG. 3 before vibration welding, showing the welding fixture.

The rib frame half 30 (FIGS. 5, 7 and 8) is molded about the perimeter of the glass 12*b* using the same technology as for the smooth frame half 20. The rib frame half 30 includes an inner surface 36, an outer surface 37 and an inside perimeter edge 29. A plurality of ribs 32 (three in the preferred embodiment) extend from the inner surface 36. Any other number of ribs or other weldable protrusions could be used. One or more ribs 32 melt during the welding operation discussed below to fuse the frame halves 20 and 30 together. The inner surface 36 defines a pair of channels 34 on either side of each rib 32. Alternatively, only one channel 34 might be included for each rib 32, or the channels 34 could be eliminated altogether. When included, the channel 34 provides a receptacle or run-out area for a portion of the melted rib 32 created during the welding step discussed below. In the preferred embodiment, the ribs 32 extend around the complete inner surface 36 and are 0.03 inches taller than the plane formed by the inner surface 36. Again, other configurations and/or other sizes also could be used.

The outer surface 37 of the rib frame half 30 defines receiver grooves 49 to provide a positive location means for receiving a welding fixture. Alternatively, the receiver grooves 49 could be provided on the smooth frame half 20 or both frame halves 20 and 30. The outer surface 37 of the rib frame half 30 may also be smooth (not shown) and the welding fixture may use the inside perimeter edge 29 as a positive location means for welding the frame halves 20 and 30 together.

II. Manufacture

The insulated glass assembly 10 is generally formed by molding the smooth frame half 20 around the glass panel 12*a*, molding the rib frame half 30 around the second glass panel 12*b*, and welding or otherwise joining the rib frame half 30 and the smooth frame half 20 together.

The rib frame half 30 is injection molded about the perimeter of the glass panel 12*b*. Any other suitable molding process also may be used. The smooth frame 20 is similarly molded about the perimeter of the glass panel 12*a*. It is desirable to form an airtight seal between the frame halves 20 and 30 and the panels 12*a* and *b*.

Prior to welding of the frame halves 20 and 30, a desiccant is applied within the desiccant channel 22 either by hand or by equipment. Preferably, care is taken to confine the dessicant to the channel 22 so that the dessicant is not readily visible in the assembly IG.

Figure 5:
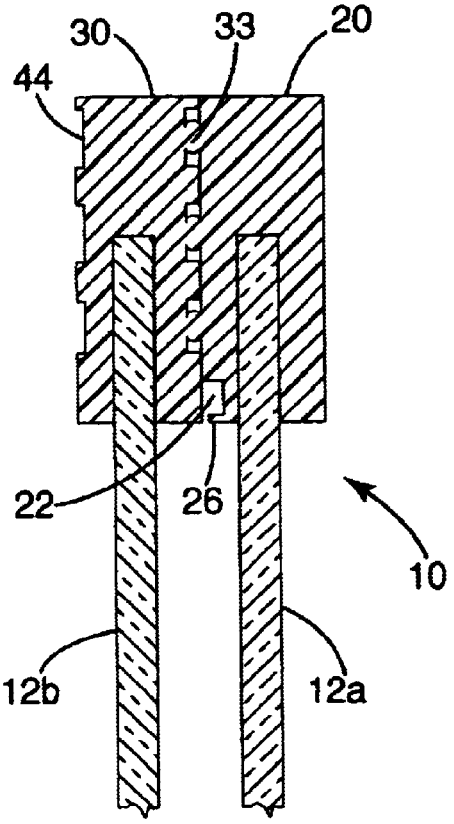
FIG. 5 is a sectional view taken of the window assembly taken along 6—6 in FIG. 1 after vibration welding.
Figure 6:
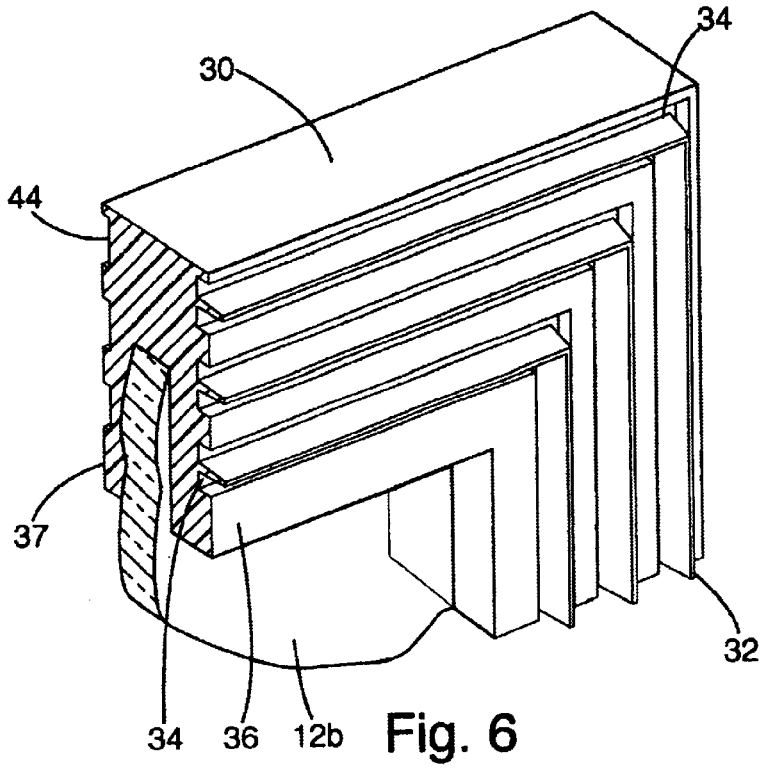
FIG. 6 is a perspective view of a corner of one of the frame halves including ribs.

The rib frame half 30 and the smooth frame half 20 are then welded or otherwise joined. In the preferred embodiment, the frame halves 20 and 30 are vibration welded together. It is also desired to make an airtight seal between the inner surfaces 24 and 36 of the frame halves 20 and 30 except where a frame half 20 or 30 may define the vent channel 40. While vibration welding is a well known art, this technique has not previously been applied to the fabrication of insulated glass. The frame halves 20 and 30 are placed within a welding jig (not illustrated) with the ribs 32 engaging the smooth frame half 20. The welding fixture 102 (FIG. 7) engages the positive location means 44. The welding fixture 102 is then vibrated at the proper frequency to cause the ribs 32 to melt and bond to the smooth frame half 20. As the ribs 32 melt, any excess plastic flows into the channels 34 as shown in FIG. 5. Alternatively, the frame halves 20 and 20 may be joined using techniques other than welding, for example, using adhesives and solvents.

If the IG assembly 10 includes the optional vent channel 40, the IG assembly 10 may be vented through the vent channel 40 by filling the enclosed space or cavity between the panels 12 with an inert gas. The vent channel 40 is then sealed to trap the inert gas within the IG assembly 10.

The above description is that of the preferred embodiment of the invention. Various alterations and changes can be made without departing from the spirit and broader aspects of the invention as set forth in the appended claims, which are to be interpreted in accordance with the principles of patent law including the doctrine of equivalents.

What is claimed is:

1. An insulated glass assembly comprising:

a first panel assembly comprising:

a first glass panel having a perimeter; and a first one-piece plastic frame molded about and encapsulating the entire said perimeter of said first glass panel;

a second panel assembly comprising:

a second glass panel having a perimeter;

a second one-piece plastic frame molded about and encapsulating the entire said perimeter of said second glass panel; and said first frame and said second frame welded directly together.

2. The insulated glass assembly of claim 1 wherein at least one of said first frame and said second frame defines a desiccant channel opening towards the respective panel.

3. An insulated glass assembly comprising:

a first panel assembly comprising:

a first glass panel having a perimeter; and a first plastic frame molded about and encapsulating the entire said perimeter of said first glass panel;

a second panel assembly comprising:

a second glass panel having a perimeter;

a second plastic frame molded about and encapsulating said perimeter of said second glass panel; and said first frame and said second frame welded together, at least one of said first frame and said second frame defining a plurality of parallel ribs fused to the opposite frame.

4. The insulated glass assembly of claim 3 wherein at least one frame member defines a vent channel substantially perpendicular to said ribs.

5. An insulated glass assembly including:

a first panel assembly including a first glass panel and a first one-piece plastic frame, said first glass panel having a perimeter, said first frame molded about said perimeter and creating an airtight seal between said first frame and said first glass panel;

a second panel assembly including a second glass panel and a second one-piece plastic frame, said second glass panel having a perimeter, said second frame molded about said second glass perimeter and creating an airtight seal between said second frame and said second glass panel; and said first frame and said second frame welded directly together to form an airtight seal between said first frame and said second frame.

6. An insulated glass assembly as defined in claim 5 wherein said first frame and said second frame are vibration welded together.

7. An insulated glass assembly as defined in claim 5 wherein said first frame comprises at least one rib and at least one channel adjacent to said rib, said rib engaging said second frame.

8. An insulated glass assembly as defined in claim 5 wherein at least one of said first and said second frames defines a desiccant channel opening toward the other of said first and second frames.

9. An insulated glass assembly comprising:

a first glass panel having a first perimeter edge, first inner glass surface and a first outer glass surface;

a first perimeter frame molded in one piece about said first perimeter edge, a portion of said first inner glass surface, and a portion of said first outer glass surface, said first perimeter frame forming an air tight seal with said first glass panel, said first perimeter frame including a first outer surface and a first inner surface including at least one rib and at least one melt down channel;

a second glass panel having a second perimeter edge, a second inner glass surface and a second outer glass surface; and a second perimeter frame molded in one piece about said second perimeter edge, a portion of said second inner glass surface, and a portion of said second outer glass surface, said second perimeter frame forming an airtight seal with said second glass panel, said second perimeter frame including a second inner and a second outer surface, said second inner surface joined to said first inner surface.

10. The insulated glass assembly of claim 9 wherein at least one of said first and said second perimeter frames defines a desiccant channel within said respective inner surface.

* * * * *